US005431557A

United States Patent [19]

Hamos

[11] Patent Number: 5,431,557

[45] Date of Patent: Jul. 11, 1995

[54] LOW NOX GAS COMBUSTION SYSTEMS

[75] Inventor: Robert E. Hamos, Simi Valley, Calif.

[73] Assignee: TeleDyne Industries, Inc., Los Angeles, Calif.

[21] Appl. No.: 167,155

[22] Filed: Dec. 16, 1993

[51] Int. Cl.[6] ..... F23D 14/16

[52] U.S. Cl. ..... 431/7; 431/328

[58] Field of Search ..... 431/7, 12, 326, 328, 431/329

[56] References Cited

U.S. PATENT DOCUMENTS

| | | | |
|---|---|---|---|
| 2,658,742 | 11/1953 | Suter et al. | 431/328 |
| 3,173,470 | 3/1965 | Wright | 158/99 |
| 4,270,896 | 6/1981 | Polinski et al. | 431/328 |
| 4,332,547 | 6/1982 | MacDonald | 431/329 |
| 4,597,734 | 7/1986 | McCausland et al. | 431/328 |
| 4,643,667 | 2/1987 | Fleming | 431/7 |
| 4,810,587 | 3/1989 | Losfeld et al. | 428/549 |
| 4,850,862 | 7/1989 | Bjerklie | 432/182 |
| 4,861,261 | 8/1989 | Krieger | 431/1 |
| 4,878,837 | 11/1989 | Otto | 431/328 |
| 4,890,601 | 1/1990 | Potter | 126/512 |
| 4,895,513 | 1/1990 | Subherwal | 431/328 |
| 4,919,609 | 4/1990 | Sarkisian et al. | 431/7 |
| 4,977,111 | 12/1990 | Tong et al. | 501/95 |
| 4,983,467 | 1/1991 | De Bruyne et al. | 428/605 |
| 5,060,629 | 10/1991 | Sirand et al. | 431/329 X |
| 5,076,781 | 12/1991 | Cremers | 431/12 X |
| 5,088,919 | 2/1992 | De Bruyne et al. | 431/328 |
| 5,112,217 | 5/1992 | Ripka et al. | 431/12 |
| 5,183,401 | 2/1993 | Dalla Betta et al. | 431/328 |
| 5,205,731 | 4/1993 | Reuther et al. | 431/328 |
| 5,211,552 | 5/1993 | Krill et al. | 431/329 X |
| 5,317,992 | 6/1994 | Joyce | 431/329 X |
| 5,340,305 | 8/1994 | Joyce | 431/7 |

FOREIGN PATENT DOCUMENTS

| | | |
|---|---|---|
| 0157432 | 10/1985 | European Pat. Off. . |
| WO93/18342 | 9/1993 | WIPO . |

OTHER PUBLICATIONS

High Efficiency Hydronic Heating Unit, Gas Research Institute, Jan. 1987.

Technology Profile, Gas Research Institute, Oct. 1985.

*Primary Examiner*—Carl D. Price

*Attorney, Agent, or Firm*—Benoit Law Corporation

[57] ABSTRACT

Air pollution from combustion of air/gas mixtures is reduced effectively and reliably at a porous burner providing flames with a downstream reaction zone where the ignition of the air/gas mixture initiates. The porous burner is loaded with the air/gas mixture sufficiently, such as at from 1000 to 2500 $kWm^{-2}$ or 2200 to 5500 Btu/sqin-hr, to locate the downstream reaction zone at a downstream surface of the porous burner, while the air/gas mixture is provided with sufficient excess air, such as more than a quarter of excess air, for the flames to burn blue. In a typical combustion of that air/gas mixture, less than 20 ppm of $NO_x$ are produced. A related method loads the porous burner with the air/gas mixture at from 1000 to 2000 $kWm^{-2}$ or 2200 to 4400 Btu/sqin-hr, while providing that air/gas mixture with more than about forty-five percent of excess air for the flames to burn blue. That combustion of the air/gas mixture including its excess air produces less than 10 ppm of $NO_x$.

20 Claims, 3 Drawing Sheets

LOW NOX GAS COMBUSTION SYSTEMS

FIELD OF THE INVENTION

The subject invention relates to gas combustion systems including gas heater or burner systems and, more particularly, to establishment and maintenance of low nitrous oxide ("NOX" for $NO_x$), CO or $CO_2$ and other pollutant emission by such gas combustion systems.

BACKGROUND OF THE INVENTION

Venturi-type and blower air/gas mixing systems with radiant fiber matrix burners are well known, as may be seen from the Final Report, January 1987, entitled *High Efficiency Hydronic Heating Unit*, Gas Research Institute, FIG. 4, etc. (see also its preceding *Gas Research Institute TECHNOLOGY PROFILE*, October 1985). That Final Report in Table 1, entitled "Burner Characteristics," mentions that $NO_x$ can be lowered with higher excess air and/or burner inserts. That prior mentioning was, however, expressly limited to flameholder type of burners and did not provide any teaching to this effect for the porous type burners.

Indeed, European Patent Application 0 157 432, entitled "Radiant surface combustion burner," by Shell Internationale Research Maatschappij B. V., inventors: D. A. C. McCausland et al, published 9 Oct. 1985, pointed out that $NO_x$ values are much higher in free-flame mode of operation, than in the radiant surface combustion mode.

This was further confirmed in U.S. Pat. No. 5,205,731, by J. J. Reuther et al, issued Apr. 27, 1993 to Battelle Memorial Institute, for "Nested-Fiber Gas Burner," and herewith incorporated by reference herein. In particular, that patent pointed out that porous, radiant burners emit only about ten percent of the nitrogen oxides, NO ($NO+NO_2$), of ported, blue-flame burners, but that port loading (energy released per unit area per unit of time, such as in $kWm^{-2}$ or in Btu/sqin-hr) of conventional radiant, porous-matrix burners was only on the order of two to five percent of ported blue-flame burners.

Both the above mentioned European patent application and United States patent operate with sintered nested-fiber gas burners having high porosity, whereby higher port loading becomes possible, given as being between 100 to 1000 $kWm^{-2}$ for porosities of 60% to 90% in the European application, and as between 800 to 5300 Btu/sqin-hr for porosities of 80% to 89% given in the Battelle patent. Especially port loadings at the higher porosities contrast very favorably to possible port loadings of 100 to 400 $kWm^{-2}$ or some 1000 Btu/sqin-hr for radiant surface combustion burners using fiber porous elements.

Both the above mentioned European application and the Battelle patent expressed preference for non-woven steel fibers containing chromium and aluminum, such as an alloy containing iron, chromium, aluminum and yttrium or FeCrAlY, or iron-chromium-aluminum electrical-resistance wire.

Both the above mentioned European application and the Battelle patent reported low nitrogen oxide emission ratios, such as between 12 and 24 ppmv at 200 and 600 $kWm^{-2}$, respectively, or less than 20 ppm at port loadings of from 800 to 5300 Btu/sqinhr, accompanied by carbon monoxide emission of less than 50 ppm. By contrast, the above mentioned European application mentions nitrogen oxide emissions of between 150 and 250 ppmv in free-flame modes of operation.

In particular, that European application mentions a free-flame mode of operation for its porous burner as occurring above 2000 $kWm^{-2}$, and a transition region between 1000 $kWm^{-2}$ and 2000 $kWm^{-2}$ wherein both surface combustion and free-flame combustion were observed.

Against this background, the above mentioned Battelle patent, as mentioned above, reported low nitrogen oxide and carbon oxide emission ratio at high port loadings of up to 5300 Btu/sqin-hr or some 2400 $kWm^{-2}$ through a retraction of the early portion of the blue flame (there called "leading edge of the flame front") into the top layer of its nested-fiber burner. In particular, the Battelle patent teaches connecting valve means to the inlet of the sintered nested-fiber burner in order to (1) control the admission of a combustible gas and oxygen mixture from a source to that burner and (2) insure that the pressure of the gas and oxygen mixture admitted to that burner locates the leading edge of the flame front of that gas/oxygen mixture, which is ignited within the mat of that sintered nested-fiber burner, to the inside of that nested-fiber burner; that is, between the inner and outer surfaces of its nested-fiber mat.

It is thus most remarkable that significant lowering of nitrogen oxide and carbon monoxide emissions was reported to have been achieved through adjustment of a simple valve in the combined combustible gas and oxygen supply line, that cannot provide any variation of the supplied oxygen or air relative to the supplied gas. Against this surprising background, the test results reported in the above mentioned European application indicate a relatively low upper limit of 600 $kWm^{-2}$ for low nitrogen oxide emission from its porous burners.

SUMMARY OF THE INVENTION

It is a primary object of the invention to reduce air pollution from combustion or burning of gas effectively and reliably.

It is a germane object of the invention to enable combustion or burning of gas with open flames while minimizing soot formation and air pollutant emission at high port loadings.

Other objects become apparent in the further course of this disclosure.

The invention resides in a method of operating a porous burner with an air/gas mixture comprising, in combination, igniting that air/gas mixture at the porous burner to produce flames with a downstream reaction zone where the ignition of the air/gas mixture initiates, loading that porous burner with the air/gas mixture sufficiently, such as at from 1000 to 2500 $kWm^{-2}$or 2200 to 5500 Btu/sqin-hr, by force-feeding to locate the downstream reaction zone at a downstream surface of the porous burner, while providing the air/gas mixture with sufficient excess air, such as more than a quarter of excess air, for the flames to burn blue in a combustion of that air/gas mixture including its excess air producing less than 20 ppm of $NO_x$.

A preferred embodiment of the invention loads the porous burner with the air/gas mixture at from 1000 to 2000 $kWm^{-2}$ or 2200 to 4400 Btu/sqin-hr, by force-feeding while providing that air/gas mixture with more than about forty-five percent of excess air for the flames to burn blue in a combustion of that air/gas mixture including its excess air producing less than 10 ppm of $NO_x$.

Method steps recited sequentially herein and in the accompanying claims for practical reasons may be performed simultaneously or in a different order as long as the method remains operative.

BRIEF DESCRIPTION OF THE DRAWINGS

The subject invention and its various aspects and objects will become more readily apparent from the following detailed description of preferred embodiments thereof, illustrated by way of example in the accompanying drawings, in which like reference numerals designate like or equivalent parts, and in which.

DESCRIPTION OF THE PREFERRED EMBODIMENTS

Figure 1:
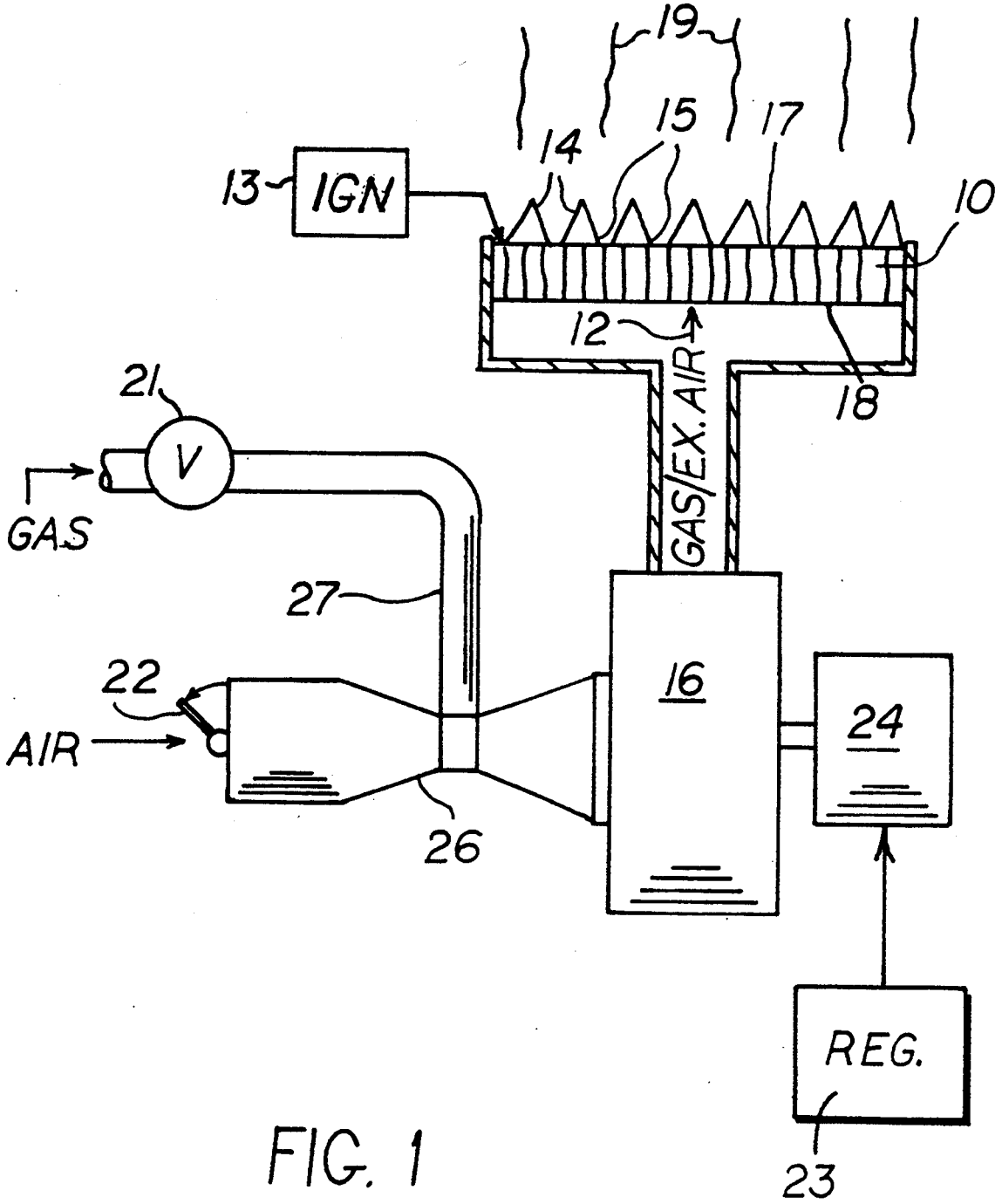
FIG. 1 is a partially sectional and diagrammatic view of apparatus used in the practice of the subject invention according to a preferred embodiment thereof.

The drawings illustrate methods and apparatus for operating a porous burner 10 with an air/gas mixture 12. As diagrammatically indicated at 13, the air/gas mixture 12 is ignited at the porous burner to produce flames 14 with downstream reaction zone 15. By way of example, the above mentioned Battelle patent calls such early portion 13 of the blue-flame the "leading edge of the flame front;" but they seem to be trailing the remainder of the flame 14, rather than leading, and they are therefore herein referred to as "downstream reaction zone", being closer to the source 16 of the air/gas mixture than the remainder of the flame 14.

The subject invention loads the porous burner 10 with the air/gas mixture 12 sufficiently to locate the downstream reaction zone 15 at a downstream surface 17 of the porous burner. In this respect, the porous burner has an upstream surface 18 closer to the source 16 of the air/gas mixture 12, and has the mentioned downstream surface 17, more remote from that source 16 than the upstream surface 18.

It may be noted that this aspect of the invention is contrary to the teaching of the above mentioned Battelle patent which locates the "leading edge of the flame front" or flame front upstream edge 15 between the inner and outer surfaces 18 and 17 of the fibrous burner mat 10 and thus well into that porous burner or mat.

According to a further aspect thereof, the invention provides the air/gas mixture 12 with sufficient excess air for the flames 14 to burn blue in a combustion of that air/gas mixture including that excess air producing less than 20 ppm of $NO_x$.

According to a preferred embodiment of the invention, the air/gas mixture 12 is provided with more than a quarter (25%) of excess air. In this respect and in general, excess air is defined by reference to a so-called stoichiometric proportion of gas and air in the air/gas mixture. In particular, excess air is the percentage (%XS) by which the amount of combustion air exceeds the stoichiometric amount. Of course, air consists of nitrogen and oxygen, such as 79% nitrogen and 21% oxygen, and only the oxygen is combusted with the gas. Accordingly, a stoichiometric combustion takes place if one part of gas is burned with ten parts of air, providing two parts of oxygen. In that case, the excess air and thereby the percentage of excess air are zero.

Without sufficient primary air in the air/gas mixture, free-flame combustion has to rely on secondary air, drawn to the flame, in addition to the primary air contained in the air/gas mixture fed to the flame. This in practice produces a yellow or radiant flame, as distinguished from a blue flame, and produces a combustion product containing high amounts of pollutants, such as more than eleven percent of carbon dioxide, and some 150 to 250 ppmv of $NO_x$ as reported in the above mentioned European patent and as implied in the Battelle patent. Also, the soot commonly associated with combustion systems stems from the yellow region of the flame. By eliminating such yellow region, soot and nitrous oxide occurrence can be drastically reduced.

The subject invention combines the above mentioned two features to reduce the amounts of air pollutants to the kind of low values generally known from radiant burners with internal combustion.

In particular, the invention loads the porous burner 10 with the air/gas mixture 12 sufficiently to locate the downstream reaction zone 15 at the downstream surface 17 of the porous burner, and the invention provides the air/gas mixture 12 with sufficient excess air for the flames 14 to burn blue in a combustion of that air/gas mixture including that excess air which produces less than 20 ppm of $NO_x$.

These two features are interactive, since sufficiently high burner loading in effect drives the flame front upstream edge 15 to the downstream porous burner surface 17, while excess air at that high burner loading assures a blue flame in a combustion that results in less pollutants, including less than 20 ppm of $NO_x$.

A preferred embodiment of the invention loads the porous burner 10 with the air/gas mixture 12 at from 1000 to 2500 $kWm^{-2}$or 2200 to 5500 Btu/sqin-hr and provides such air/gas mixture with sufficient excess air for the flames 14 to burn blue in a combustion of that air/gas mixture 12 including the excess air that produces less than 20 ppm of $NO_x$.

In this respect, FIG. 1 shows three adjustments that can be made to effect the required burner loading and to assure the desired low level of pollutants in the combustion product or flue gases 19.

First, a gas regulator or other valve 21 can be employed adjust he amount or proportion of gas in the air/gas mixture. Secondly, an air-flow regulator or baffle 22 can be used adjust the amount or proportion of oxygen o air, including the desired amount of percentage of excess air, in the air/gas mixture. Thirdly a regulator or control 23 can be provided to assure the desired pressure of the air/gas mixture in, or the desired loading of, the porous burner 10 with the air/gas mixture 12, expressed in $kWm^{-2}$ or Btu/sqin-hr.

Of course, the three controls 21, 22 and 23 may be adjusted relative to each other to provide the required admixture of gas and primary air and excess air at the required or desired burner loading for a blue flame formation with low pollutant combustion product.

Figure 2:
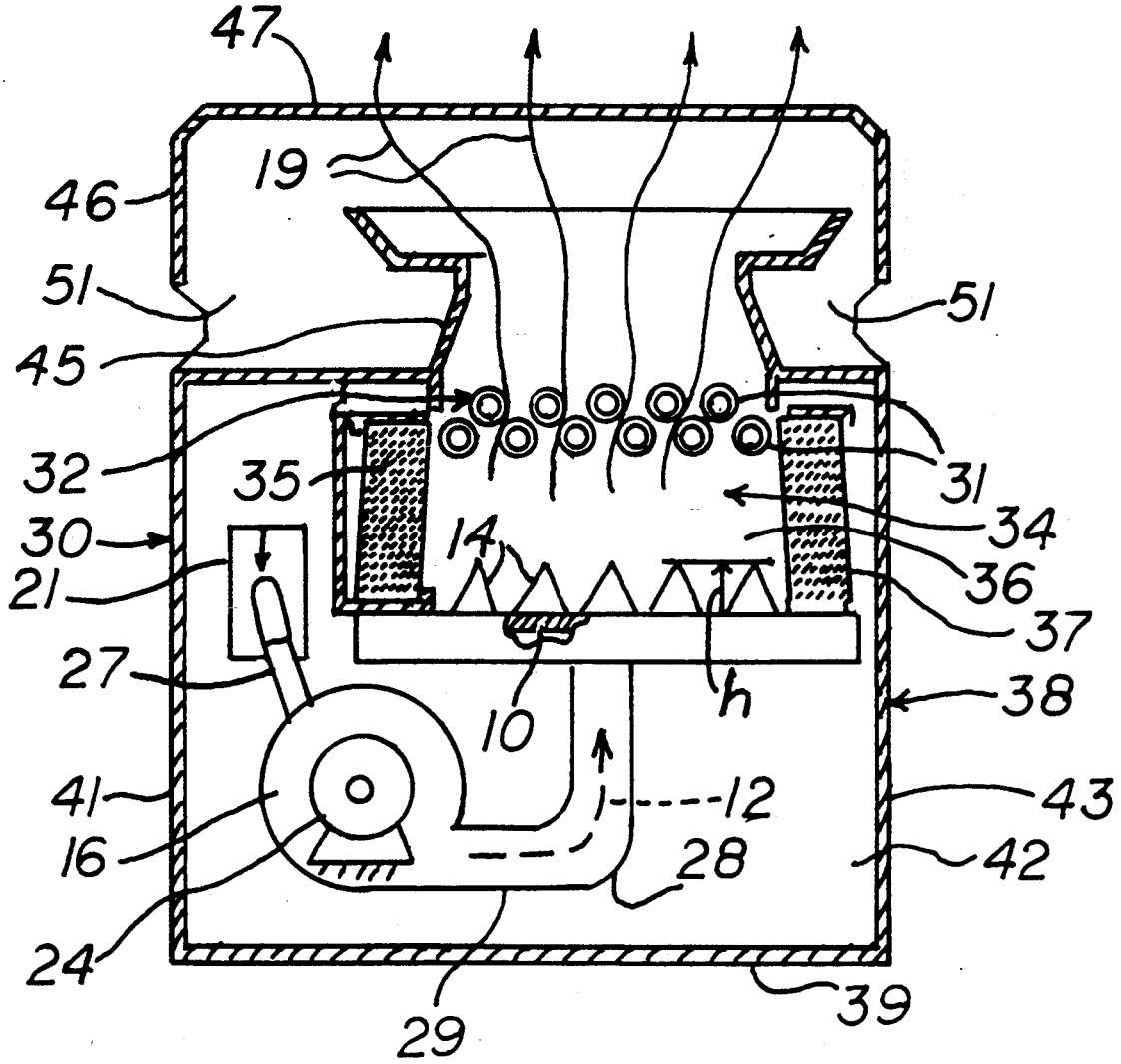
FIG. 2 is a partially sectioned view of a heater apparatus in which the subject invention may be practiced according to a further embodiment thereof; a lower region of FIG. 2 containing a side view of part of the apparatus shown in FIG. 1 on a different scale.

FIG. 1 and 2 show a blower 16 for force-feeding the air/gas mixture 12 to the burner 10 or flames 14. The gas and the air in the air/gas mixture 12 are intimately admixed by feeding that air/gas mixture including the excess air through the blower and force-feeding such air/gas mixture including the excess air to the porous burner 10 with that blower.

The blower 16 may be driven by an electric motor 24 having blower motor control or speed regulator 23 with which the pressure of the air/gas mixture can be increased until the desired blue flames 14 develop by combustion of the force-fed air/gas mixture, as described above and as more fully described below.

The invention may be practiced with all kinds of combustible gases, including butane gas, propane gas, natural gas, and manufactured gas, such as city gas made from coke. The air is forced-fed and combusted with the butane, propane, natural or manufactured gas so that the flames 14 are blue.

By way of example, FIG. 1 shows a venturi structure 26 for mixing the gas applied thereto by a gas line 27 with the primary air, and for applying such air/gas mixture to the blower 16 for force-feeding to the porous burner 10. In certain models, the speed regulation 23 may be inherent in the blower motor which can be designed so that the pressure of the air/gas mixture is just right for the desired blue-flame and low pollutant effect. Venturi-type and blower air/gas mixing systems with radiant fiber matrix burners have been known before, as may be seen from the above mentioned Final Report, January 1987, entitled *High Efficiency Hydronic Heating Unit*, Gas Research Institute, FIG. 4, etc. (see also *Gas Research Institute TECHNOLOGY PROFILE*, October 1985). Pursuant to the subject invention, such a unit would be designed and operated to issue blue flames in the manner herein disclosed and discussed with reference to the flames 14 shown in FIGS. 1 and 2 hereof.

Figure 3:
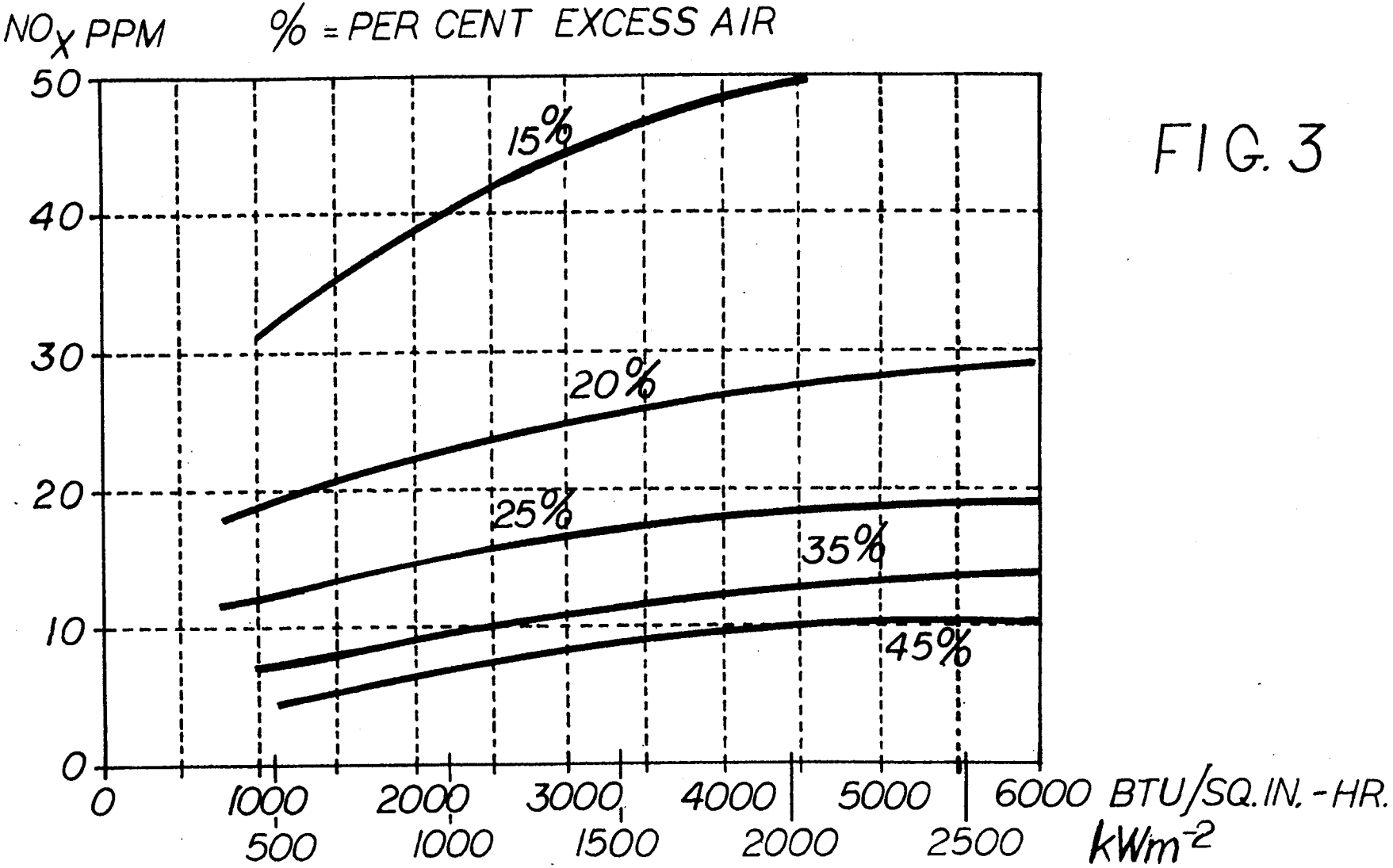
FIG. 3 is a graph showing nitrous oxide emission in terms of percentage of excess air for different burner loadings expressed in Btu/sqin-hr and in $kWm^{-2}$, with values within the scope of the invention being shown below the 20 ppm $NO_x$ line in FIG. 3.

Mixing systems other than the one shown in FIGS. 1 and 2 may be employed within the scope of the invention, but the system shown in FIGS. 2 and 3 makes for a particularly intimate air/gas admixture.

A preferred embodiment of the invention intimately admixes the gas and the air in the air/gas mixture by forcing such air/gas mixture including the excess air through a flow impedance ahead of the porous burner 10, since intimate admixture improves combustion so as to promote reduced pollutants in the combustion product 19. Such impedance may take many forms, but FIG. 2 shows such impedance in the form of a bent portion 28, in a pipe 29 in which the air/gas mixture 12, including the excess air, is force-fed to the porous burner 10.

In other words, the apparatus shown in FIG. 2, part of which may be considered as a side view of FIG. 1, intimately admixes the gas and the air the said air/gas mixture by forcing that air/gas mixture including the excess air through a bent path 28 ahead of the porous burner 10.

Further intimate admixture of the gas and air in the air/gas mixture 12 takes place in the porous burner.

The graph of FIG. 3 shows the effect of excess air and port loading on the nitrous oxide or $NO_x$ emission in the combustion product. These graphs are the results of test conducted with a sintered porous burner of the type disclosed in the Battelle patent. The port loadings or porous burner loadings are expressed in Btu/sqin-hr and in corresponding $kWm^{-2}$. The nitrous oxide or $NO_x$ emissions in the combustion product or flue gas 19 are expressed in parts per million, ppm air-free, meaning that all oxygen in the air of the supplied air/gas mixture 12 is used in the combustion. The percentages throughout the graph of FIG. 3 are percent of excess air over the above mentioned stoichiometric amount. The gas was natural gas in the tests represented in FIG. 3, but the depicted values are representative of butane gas, propane gas, and manufactured gas.

The curve in the upper part of FIG. 3 shows that for 15% of excess air, the $NO_x$ emission of the combustion increased from over 30 ppm to almost 50 ppm at a port loading that increased from 1000 Btu/sqin-hr or about 455 $kWm^{-2}$ to a port loading of 4500 Btu/sqin-hr or about 2045 $kWm^{-2}$ with natural gas.

The lower portion of FIG. 3 also indicates that according to a preferred embodiment of the invention, a quarter of excess air (25%) is necessary to lower the $NO_x$ emission to the less than 20 ppm reported in the Battelle patent for port loadings of 800 to 5300 Btu/sqin-hr or about 365 to 2730 $kWm^{-2}$. Also contrary, to the above mentioned European application, FIG. 3 indicates that low $NO_x$ emissions are achievable according to the subject invention at port loadings of more than the 600 $kWm^{-2}$ (1320 Btu/sqin-hr) for which the European application reported some 24 ppmv of $NO_x$.

Indeed, a preferred embodiment of the subject invention loads the porous burner 10 with the air/gas mixture at from 500 to 2000 $kWm^{-2}$ or 1100 to 4400 Btu/sqin-hr, while providing such air/gas mixture 12 with more than about forty-five percent of excess air for the flames 14 to burn blue in a combustion of that air/gas mixture including that excess air producing less than 10 ppm of $NO_x$, as apparent from FIG. 3.

Tests further showed that some 60% to 70% of excess air in the air/gas mixture 12 reduced the $NO_x$ emission to zero for natural gas combustion for the kind of port loadings mentioned in the Battelle patent and its predecessor European application.

These embodiments advantageously may employ the above mentioned measures of intimately admixing the gas and the air in the air/gas mixture by forcing such air/gas mixture 12 including its excess air through a bent path 28 or other flow impedance ahead of the porous burner 10, and/or by feeding that air/gas mixture 12 including its excess air through a blower 16 and force-feeding such air/gas mixture including its excess air to the porous burner with that blower.

FIG. 2 further shows an embodiment applying the principles of the subject invention to fluid heaters. Those skilled in the art may recognize the fluid heater 30 as being of a type whose predecessor, without the features of the subject invention, has been widely manufactured and sold, mostly for swimming pool and spa heating purposes. That prior-art predecessor, like most heaters of its kind, burns with an open flame that relies on the attraction of secondary air for a conventional combustion process that produces the kind of high atmospheric pollutants, including for instance the 150 to 250 ppmv $NO_x$ reported in the above mentioned European patent for the high port loadings customary in free-flame combustion.

However, the embodiment of the invention shown in FIG. 2 avoids that drawback of conventional heaters by applying thereto tile principles of the subject invention as implemented in its embodiment shown in FIG. 1 and described above, with like reference numerals a among FIGS. 1 and 2 designating substantially like parts and subject matter.

According to FIG. 2, the blue flames 14 are used to heat water or other fluid 31 in a heat exchanger 32 spaced from the burner 10 to accommodate such flames.

Upon ignition of the air/gas mixture 12, the gas flames 14 generate heat in the heater chamber 34, which may at least partially be defined by four walls of refractory material, three of which are seen in FIG. 1 at 35, 36 and 37, and the fourth or front-most of which has been omitted to show the inside of the heater chamber 34.

The illustrated heating appliance 30 includes a housing 38 having a closed bottom 39 and four side walls, three of which are seen in FIG. 2 at 41, 42 and 43, and the fourth or front-most of which has been removed to show the inside of the heater. The rear wall may have an opening or louvre (not visible in FIG. 2) for the admission of operating air to the venting structure seen in FIG. 1, from atmosphere.

The heating appliance 30 has an outlet 45 for the flue products 19 above the heat exchanger 32. The housing 38 has a top structure 46 which has exhaust openings, such as at 47, for the flue products 19.

A special top or adaptor of a conventional type (not shown) may be used to adapt the heating appliance to use with a flue pipe or smokestack (not shown). Moreover, one or more air inlet openings 51 may be provided in the top structure 46 to aid the cooling and exhaustion of flue products. Other modifications may be effected to adapt the heating appliance to use in various wind conditions; if used outdoors.

The subject invention provides a combination of features to reduce nitrous oxide emission. As illustrated with the aid of the embodiments shown in FIGS. 1 to 3, or otherwise within the scope of the invention, the loading of the burner surface is increased to provide a blue flame as contrasted from a radiant flame.

The embodiment of the invention illustrated in FIG. 2 spaces the heat exchanger 32 from the porous burner 10 so as to accommodate gas flames 14 of a height in a one-inch range from that burner. In other words, the prior-art spacing of more than one foot or 30 cm is avoided and a more compact heater 30 is provided as a result.

Of course, as in FIG. 2, a certain head space is provided in the heater chamber 34 between the top of the flames 14 and the heat exchanger 32, to prevent the flames from burning the heat exchanger, or from boiling the fluid 31 therein, unless steam generating is desired in the natural operation of the heater.

By way of example, fluids 31 suitable for heating pursuant to the subject invention include air and water for air or water heaters, respectively.

In addition to the non-woven or nested fiver burners shown in the above mentioned European application and in the Battelle patent, burners with which the subject invention may be practiced include the porous burners disclosed in U.S. Pat. No. 3,173,470, by J. S. Wright, issued Mar. 16, 1965, for Gas-Fueled Radiant Heater, U.S. Pat. No. 4,850,862, by John W. Bjerklie, issued Jul. 25, 1989, for Porous Body Combustor/Regenerator, U.S. Pat. No. 4,878,837, by Nancy M. Otto, issued Nov. 7, 1989, for Infrared Burner, U.S. Pat. No. 4,895,513, by Bodh R. Subherwal, issued Jan. 23, 1990, for Heat Resistant Combustion Element, U.S. Pat. No. 4,977,111, by Timothy W. Tong et al, issued Dec. 11, 1990, for Porous Radiant Burners Having Increased Radiant Output, and U.S. Pat. No. 5,088,919, by Roger De Bruyne et al, issued Feb. 18, 1992, for Burner Membrane.

Of course, in all these cases, the porosity of the porous burner 10 is made sufficiently high to permit the kind of loading shown in FIGS. 3 and 4, for instance.

Contrary to the above mentioned European patent application, the subject invention does not limit itself to low port loadings of less than 600 $kWm^{-2}$ for $NO_x$ emissions of less than 20 ppm and less than 200 $kWm^{-2}$ for $NO_x$ emissions of less than 10 ppm.

Also contrary to the Battelle patent, the subject invention does not limit the combustion process in terms of a withdrawal of the leading edge of the flame front into the inside of the nested fiber or porous burner, but heats the space, such as the space 34, and fluids, such as the fluid 31 in the heat exchanger 32, with open flames on the burner surface, at high port loadings.

I claim:

1. A method of operating a porous burner with an air/gas mixture, comprising in combination:

igniting said air/gas mixture at said porous burner to produce flames with a downstream reaction zone;

loading said porous burner with said air/gas mixture sufficiently by force-feeding to locate said downstream reaction zone at a downstream surface of said porous burner; and providing said air/gas mixture with sufficient excess air for said flames to burn blue in a combustion of said air/gas mixture including said excess air producing less than 20 ppm of $NO_x$.

2. A method as in claim 1, wherein:

said air/gas mixture is provided with more than a quarter of excess air.

3. A method as in claim 1, including:

intimately admixing the gas and the air in said air/gas mixture by forcing said air/gas mixture including said excess air through a flow impedance ahead of said porous burner.

4. A method as in claim 3, wherein:

said air/gas mixture is provided with more than a quarter of excess air.

5. A method as in claim 1, including:

intimately admixing the gas and the air in said air/gas mixture by forcing said air/gas mixture including said excess air through a bent path ahead of said porous burner.

6. A method as in claim 5, wherein:

said air/gas mixture is provided with more than a quarter of excess air.

7. A method as in claim 1, wherein:

the gas and the air in said air/gas mixture are intimately admixed by feeding said air/gas mixture including said excess air through a blower and force-feeding air/gas mixture including said excess air to said porous burner with said blower.

8. A method as in claim 7, wherein:

said air/gas mixture is provided with more than a quarter of excess air.

9. A method of operating a porous burner with an air/gas mixture, comprising in combination:

igniting said air/gas mixture at said porous burner to produce flames with a downstream reaction zone;

loading said porous burner with said air/gas mixture at from 1000 to 2500 $kWm^{-2}$ or 2200 to 5500 Btu/-sqin-hr; by force-feeding and providing said air/gas mixture with sufficient excess air for said flames to burn blue in a combustion of said air/gas mixture including said excess air producing less than 20 ppm of $NO_x$.

10. A method as in claim 9, wherein:

said air/gas mixture is provided with more than a quarter of excess air.

11. A method as in claim 9, including:

intimately admixing the gas and the air in said air/gas mixture by forcing said air/gas mixture including said excess air through a flow impedance ahead of said porous burner.

12. A method as in claim 11, wherein:

said air/gas mixture is provided with more than a quarter of excess air.

13. A method as in claim 9, including:

intimately admixing the gas and the air in said air/gas mixture by forcing said air/gas mixture including said excess air through a bent path ahead of said porous burner.

14. A method as in claim 13, wherein:

said air/gas mixture is provided with more than a quarter of excess air.

15. A method as in claim 9, wherein:

the gas and the air in said air/gas mixture are intimately admixed by feeding said air/gas mixture including said excess air through a blower and force-feeding air/gas mixture including said excess air to said porous burner with said blower.

16. A method as in claim 15, wherein:

said air/gas mixture is provided with more than a quarter of excess air.

17. A method of operating a porous burner with an air/gas mixture, comprising in combination:

igniting said air/gas mixture at said porous burner to produce flames with a downstream reaction zone;

loading said porous burner with said air/gas mixture at from 1000 to 2000 $kWm^{-2}$ or 2200 to 4400 Btu/-sqin-hr; by force-feeding and providing said air/gas mixture with more than about forty-five percent of excess air for said flames to burn blue in a combustion of said air/gas mixture including said excess air producing less than 10 ppm of $NO_x$.

18. A method as in claim 17, including:

intimately admixing the gas and the air in said air/gas mixture by forcing said air/gas mixture including said excess air through a flow impedance ahead of said porous burner.

19. A method as in claim 17, including:

intimately admixing the gas and the air in said air/gas mixture by forcing said air/gas mixture including said excess air through a bent path ahead of said porous burner.

20. A method as in claim 17, wherein:

the gas and the air in said air/gas mixture are intimately admixed by feeding said air/gas mixture including said excess air through a blower and force-feeding air/gas mixture including said excess air to said porous burner with said blower.

* * * * *